US010870252B2

(12) United States Patent
Shin

(10) Patent No.: US 10,870,252 B2
(45) Date of Patent: Dec. 22, 2020

(54) FOLDING MACHINE FOR FORMING FOLDED PAPER HANDKERCHIEFS

(71) Applicant: CHAN LI MACHINERY CO., LTD., Taoyuan (TW)

(72) Inventor: Wen-Hsiang Shin, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 151 days.

(21) Appl. No.: 16/148,162

(22) Filed: Oct. 1, 2018

(65) Prior Publication Data

US 2019/0099974 A1 Apr. 4, 2019

(30) Foreign Application Priority Data

Oct. 2, 2017 (TW) ..... 106214634 U

(51) Int. Cl.

| | |
|---|---|
| ***B31D 1/04*** | (2006.01) |
| ***B65H 45/28*** | (2006.01) |
| ***B65H 45/22*** | (2006.01) |
| ***B65H 45/16*** | (2006.01) |
| ***B31F 1/07*** | (2006.01) |

(52) U.S. Cl.

CPC ..... *B31D 1/04* (2013.01); *B31F 1/07* (2013.01); *B65H 45/16* (2013.01); *B65H 45/226* (2013.01); *B65H 45/28* (2013.01); *B31D 2201/00* (2013.01); *B31F 2201/07* (2013.01); *B31F 2201/0733* (2013.01); *B31F 2201/0779* (2013.01); *B65H 2406/33* (2013.01); *B65H 2701/1924* (2013.01)

(58) Field of Classification Search

CPC ..... B31F 1/0016; B31F 1/0064; B31F 5/005; B31D 1/026; B31D 1/04; B31D 5/00; B31D 5/04; B31D 2205/0047

USPC ..... 493/356, 357, 358, 359, 397, 400, 401, 493/405, 480

See application file for complete search history.

(56) References Cited

U.S. PATENT DOCUMENTS

| | | | | |
|---|---|---|---|---|
| 4,022,457 A * | 5/1977 | Marin | B65H 45/22 | 493/399 |
| 5,011,017 A * | 4/1991 | Giesen | A47G 11/001 | 206/494 |
| 5,298,009 A * | 3/1994 | Long | B42C 3/00 | 493/342 |
| 6,375,605 B1 * | 4/2002 | Niedermeyer | B65H 45/28 | 493/231 |
| 8,920,298 B2 * | 12/2014 | Gerhard | B65H 45/28 | 493/356 |

(Continued)

*Primary Examiner* — Hemant Desai
*Assistant Examiner* — Christopher Robin Kim
(74) *Attorney, Agent, or Firm* — Rosenberg, Klein & Lee

(57) ABSTRACT

A folding machine for paper handkerchiefs is disclosed. The folding machine includes a longitudinal folding unit and a transverse folding unit, wherein the longitudinal folding unit executes a longitudinal folding procedure to a paper web to obtain a paper web with longitudinal folds, and the transverse folding unit receives the paper web with longitudinal folds from the longitudinal folding unit and cuts it into paper handkerchiefs before executing a transverse folding procedure to the paper handkerchiefs, thereby completing the folding process for paper handkerchiefs. After being folded longitudinally and transversely, the paper handkerchief is effectively reduced in size for packaging and is convenient for users to carry.

10 Claims, 6 Drawing Sheets

(56) References Cited

U.S. PATENT DOCUMENTS

| | | | | |
|---|---|---|---|---|
| 8,939,879 | B2 * | 1/2015 | Yamamoto | A61F 13/15747 493/440 |
| 2003/0125179 | A1 * | 7/2003 | Evans | B65H 45/221 493/405 |
| 2004/0110621 | A1 * | 6/2004 | Katilas | B65H 45/30 493/405 |
| 2007/0144324 | A1 * | 6/2007 | Robert | B65H 45/28 83/659 |
| 2007/0179037 | A1 * | 8/2007 | Dobrovolsky | B31F 1/0025 493/480 |
| 2009/0163340 | A1 * | 6/2009 | Wang | B65H 45/142 493/405 |
| 2009/0239727 | A1 * | 9/2009 | Wingate | B26D 1/405 493/356 |
| 2011/0101593 | A1 * | 5/2011 | Imazu | G03G 15/6573 270/45 |
| 2011/0196331 | A1 * | 8/2011 | Nakakado | A61F 13/15723 604/385.01 |
| 2012/0324633 | A1 * | 12/2012 | Back et al. | A61F 13/15747 2/400 |
| 2014/0179504 | A1 * | 6/2014 | Nakada | B31F 1/0025 493/405 |
| 2014/0187405 | A1 * | 7/2014 | Volp | B31F 1/0029 493/356 |
| 2015/0136035 | A1 * | 5/2015 | Takahashi | B31D 1/04 119/161 |
| 2015/0321872 | A1 * | 11/2015 | Hari | B65H 29/60 493/405 |
| 2019/0099974 | A1 * | 4/2019 | Shin | B31F 1/07 |

* cited by examiner

FOLDING MACHINE FOR FORMING FOLDED PAPER HANDKERCHIEFS

REFERENCE TO RELATED APPLICATIONS

This non-provisional application claims priority claim under 35 U.S.C. § 119(a) on Taiwan Patent Application No. 106214634 filed Oct. 2, 2017, the entire contents of which are incorporated herein by reference.

FIELD OF THE INVENTION

The invention relates to a folding machine, more particularly, to a folding machine for forming folded paper handkerchiefs.

BACKGROUND

Nowadays, people often bring small paper hygiene products like paper handkerchief or tissue paper when they go out, for cleaning purposes.

In order to miniaturize the packaging of paper handkerchiefs, the paper handkerchief usually needs to be folded multiple times during packaging process. However, it is common in the conventional paper handkerchief folding process to have issues because of the folding device having a folding board that was short in length. The issues are that the paper is easily wrinkled, production quality is affected, or that the width or length of the folded paper handkerchief does not meet the regulated size and thus requires the process to be paused to reset the positioning of the folding board, thereby causing a low production efficiency.

SUMMARY

One objective of the present invention is to provide a folding machine that can fold paper handkerchiefs into specific sizes. The folding machine includes a longitudinal folding unit for executing a longitudinal folding procedure to a paper web and a transverse folding unit for executing a transverse folding procedure to the longitudinally-folded paper web for forming paper handkerchiefs.

It is another objective of the present invention to provide a folding machine, wherein the longitudinal folding unit includes a plurality of longitudinal folding boards, and each longitudinal folding board is respectively coupled to a corresponding adjustment hand wheel. An operator of the folding machine can control the width of the longitudinally-folded paper web by adjusting the position of each longitudinal folding board through the corresponding adjustment hand wheel, thereby meeting the size requirement for longitudinally-folded paper web and increasing the production quality and quantity of paper handkerchiefs without the need of halting the operation.

It is another objective of the present invention to provide a folding machine, wherein the transverse folding unit includes a plurality of a plurality of platen wheels for pressing paper handkerchiefs that have been longitudinally and transversely folded, thereby making the folding lines more distinctive on the paper handkerchiefs for achieving a better folding effect.

To achieve the above objects, the present invention provides a folding machine for forming paper handkerchiefs folded in a longitudinally direction and a transverse direction, and the folding machine includes a longitudinal folding unit and a transverse folding unit. The longitudinal folding unit includes a first longitudinal folding board with a first bevel edge, a second longitudinal folding board with a second bevel edge, a third longitudinal folding board with a third bevel edge, and a fourth longitudinal folding board with a fourth bevel edge. The first bevel edge is approximately parallel to the third bevel edge, and the second bevel edge is approximately parallel to the fourth bevel edge, wherein a part of the second bevel edge of the second longitudinal folding board and a part of the fourth bevel edge of the fourth longitudinal folding board are overlapped. The second longitudinal folding board and the third longitudinal folding board are disposed between the first longitudinal folding board and the fourth longitudinal folding board, and the third longitudinal folding board is mounted above the second longitudinal folding board. A paper web is fed to the longitudinal folding unit, wherein one side of the paper web folds inwardly in the longitudinal direction along the first bevel edge of the first longitudinal folding board, and the longitudinally folded side of the paper web passes through a gap between the second longitudinal folding board and the third longitudinal folding board whereas another side of the paper web folds inwardly in the longitudinal direction along the second bevel edge of the second longitudinal folding board. The another longitudinally folded side of the paper web passes through a gap between the second longitudinal folding board and the fourth longitudinal folding board. The transverse folding unit is disposed beside the longitudinal folding unit to receive the longitudinally folded paper web. The transverse folding unit includes a cutter wheel having at least three cutters, a bed knife wheel disposed next to the cutter wheel and having at least three bed knives, a first folding wheel, a second folding wheel, and a main folding wheel, wherein the bed knife wheel, the first folding wheel, and the second folding wheel are respectively disposed respectively next to the main folding wheel. The paper web is fed between the cutters of the cutter wheel and the bed knives of the bed knife wheel and is sequentially cut into a paper handkerchief, respectively. Each of the paper handkerchiefs is adhered to the main folding wheel and is delivered thereby to the first folding wheel and the second folding wheel sequentially, wherein the first folding wheel is for folding the paper handkerchief in the transverse direction for a first time and the second folding wheel is for folding the paper handkerchief in the transverse direction for a second time.

In one embodiment of the invention, the first longitudinal folding board is connected to a first adjustment hand wheel, the second longitudinal folding board is connected to a second adjustment hand wheel, and the fourth longitudinal folding board is connected to a third adjustment hand wheel. A position of the first longitudinal folding board can be adjusted by the first adjustment hand wheel, a position of the second longitudinal folding board and a position of the third longitudinal folding board can be adjusted by the second adjustment hand wheel, and a position of the fourth longitudinal folding board can be adjusted by the third adjustment hand wheel.

In one embodiment of the invention, the folding machine further includes an embossing wheel and an embossing adjustment device disposed next to the embossing wheel, wherein the paper web is delivered on the embossing adjustment device and the embossing adjustment device is used to adjust where on the paper web the embossing wheel will emboss. The longitudinal folding unit folds the embossed paper web longitudinally.

In one embodiment of the invention, the folding machine further includes a paper web tension adjustment device. The paper web tension adjustment device includes a servomotor and two delivery wheels with rough surface, wherein the servomotor is electrically connected to the two delivery wheels and controls the rotation speed of the two delivery wheels in a way of acceleration and deceleration. The paper web is delivered to the longitudinal folding unit via the paper web tension adjustment device.

In one embodiment of the invention, the transverse folding unit further includes a first platen wheel and a second platen wheel, both of which are disposed next to the main folding wheel. The paper handkerchief folded transversely for the first time is delivered by the main folding wheel to the first platen wheel and is pressed on the main folding wheel by the first platen wheel. The paper handkerchief folded transversely for the second time is delivered to the second platen wheel by the main folding wheel and is pressed on the main folding wheel by the second platen wheel.

In one embodiment of the invention, the first folding wheel includes a first folding knife and a first air hole, wherein the first folding wheel adheres the paper handkerchief from the main folding wheel via the first air hole for folding the paper handkerchief transversely for the first time.

In one embodiment of the invention, an arc length between the first folding knife and the first air hole is one half of a total length of the paper handkerchief. When a length of the paper handkerchief being adhered to the first folding wheel is equal to one half of the total length of the paper handkerchief, the first air hole releases air and the paper handkerchief is folded transversely for the first time under the influence of the first folding knife.

In one embodiment of the invention, the second folding wheel includes a second folding knife and a second air hole, wherein the second folding wheel adheres to the paper handkerchief from the main folding wheel via the second air hole so as to fold the paper handkerchief transversely for the second time.

In one embodiment of the invention, an arc length between the second folding knife and the second air hole is one fourth of the total length of the paper handkerchief. When a length of the paper handkerchief being adhered to the second folding wheel is equal to one fourth of the total length of the paper handkerchief, the second air hole releases air and the paper handkerchief is folded transversely for the second time under the influence of the second folding knife.

In one embodiment of the invention, the folding machine further includes a divert wheel disposed next to the main folding wheel. The divert wheel includes a plurality of air holes. The divert wheel adheres the paper handkerchief, which has folded transversely for the second time, from the main folding wheel via the air holes, and with a rotation of the divert wheel, the paper handkerchief folded transversely for the second time is delivered to a collecting mechanism.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
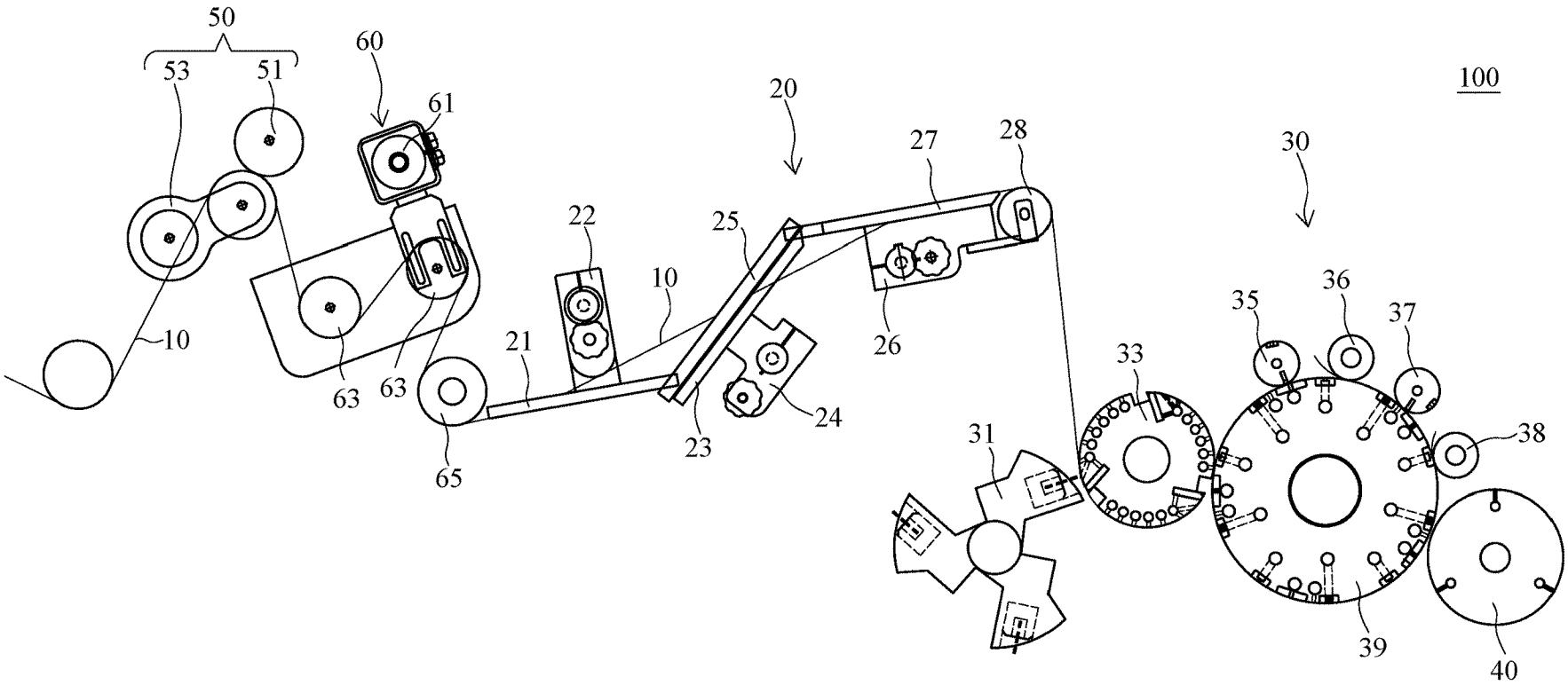
FIG. 1 is a schematic diagram of a folding machine for forming paper handkerchiefs according to an embodiment of the invention.
Figure 2:
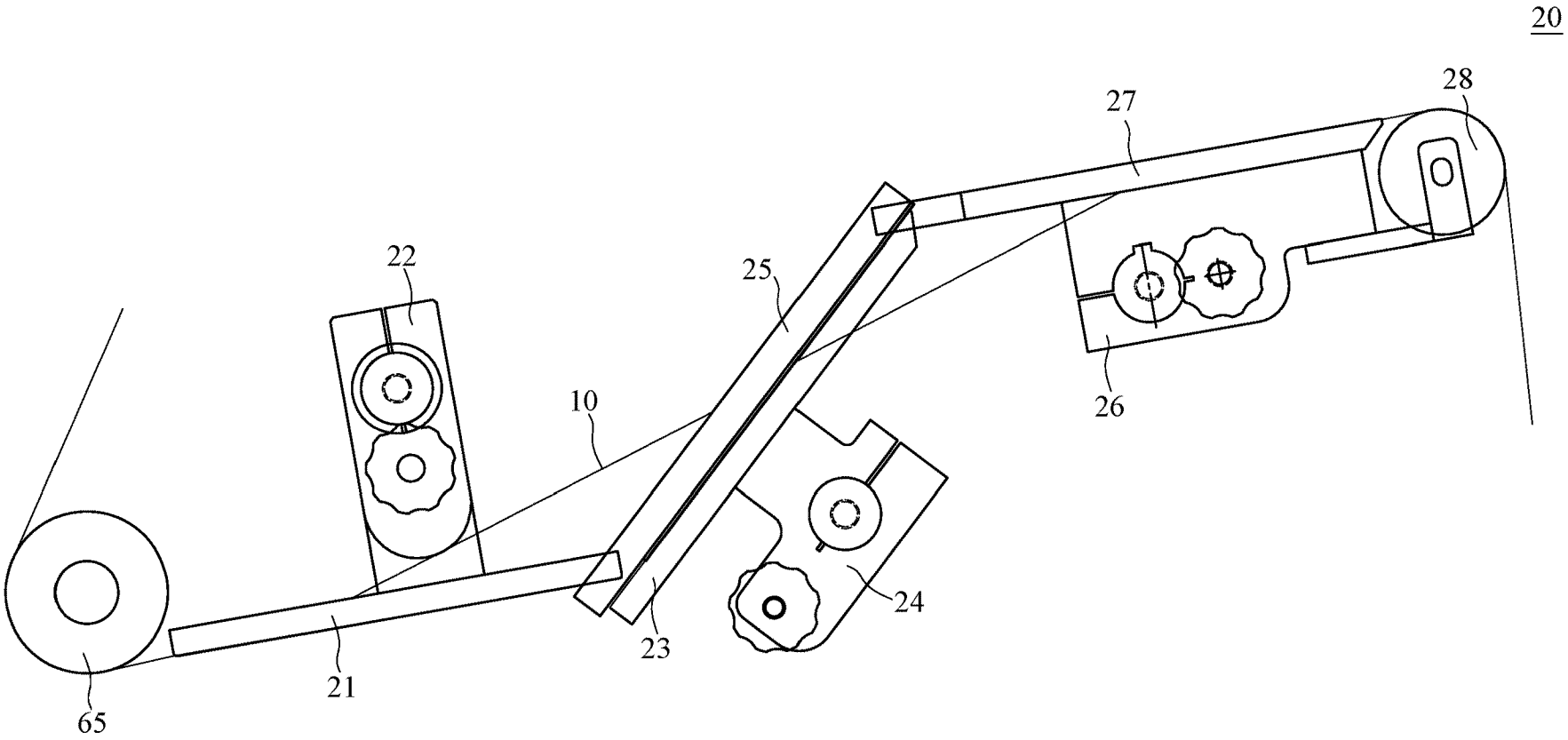
FIG. 2 is a schematic diagram of a longitudinal folding unit according to an embodiment of the invention.
Figure 3:
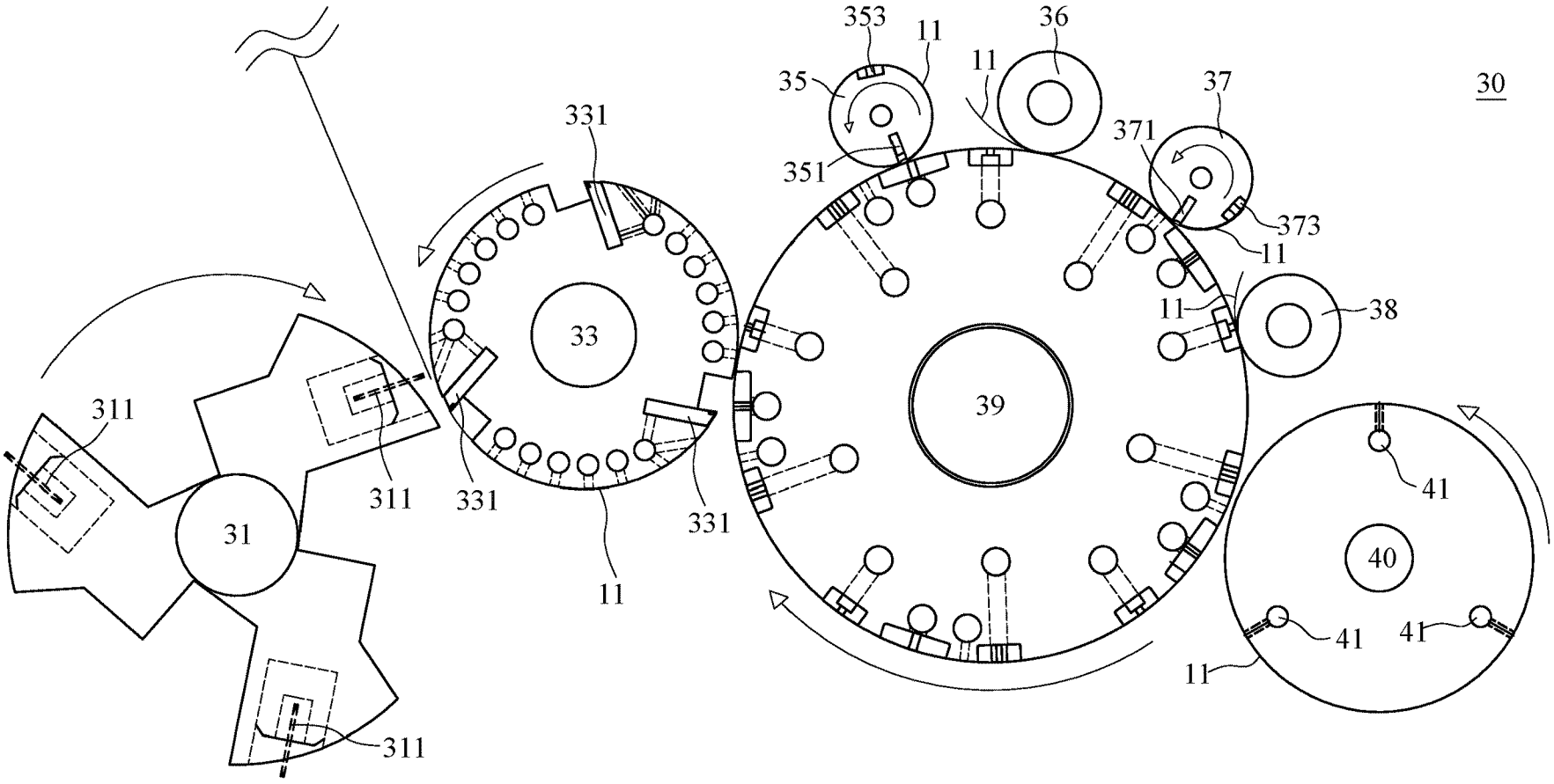
FIG. 3 is a schematic diagram of a transverse folding unit according to an embodiment of the invention.

FIGS. 1-3 are, respectively, schematic diagrams of a folding machine for forming paper handkerchiefs, a longitudinal folding unit, and a transverse folding unit according to a preferred embodiment of the invention. The folding machine 100 includes a longitudinal folding unit 20 and a transverse folding 30, wherein a paper web 10 for making paper handkerchiefs passes through the longitudinal folding unit 20 and the transverse folding unit 30 in sequence. The longitudinal folding unit 20 executes a longitudinal folding procedure to the paper web 10 and the transverse folding unit 30 executes a transverse folding procedure to the longitudinally-folded paper web 10 for forming paper handkerchiefs.

Figure 4:
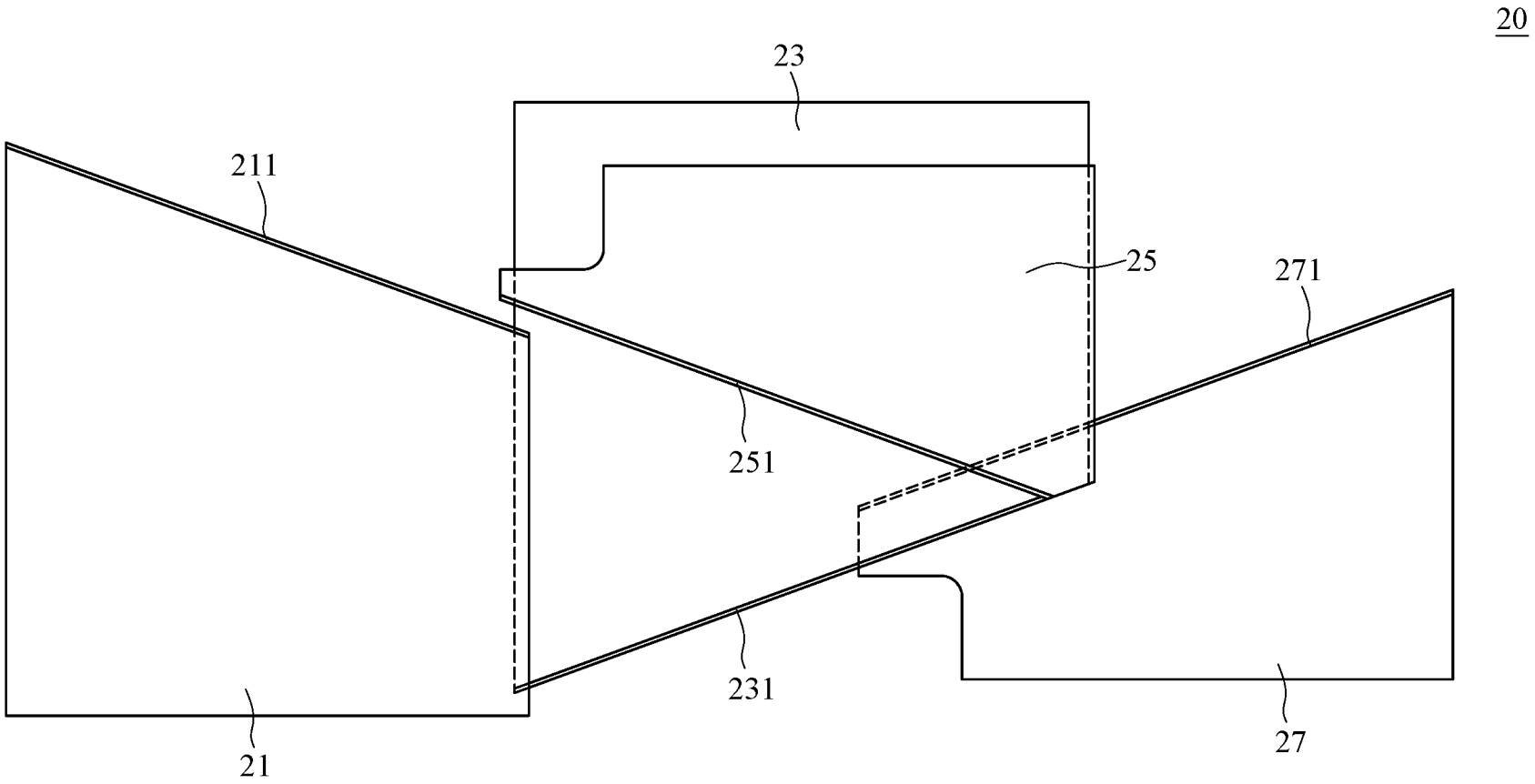
FIG. 4 is a top view of a schematic diagram illustrating a plurality of longitudinal folding boards according to an embodiment of the invention.

The longitudinal folding unit 20 includes a first longitudinal folding board 21, a second longitudinal folding board 23, a third longitudinal folding board 25, and a fourth longitudinal folding board 27. The second and the third longitudinal folding boards 23, 25 are disposed between the first longitudinal folding board 21 and the fourth longitudinal folding boards 27, and the third longitudinal folding board 25 is mounted above the second longitudinal folding board 23. In this present invention, the four longitudinal folding boards 21, 23, 25, 27 are approximately right-trapezoid shaped. As shown in FIG. 4, the first longitudinal folding board 21 includes a first bevel edge 211, the second longitudinal folding board 23 includes a second bevel edge 231, the third longitudinal folding board 25 includes a third bevel edge 251, and the fourth longitudinal folding board 27 includes a fourth bevel edge 271. A short side of the first longitudinal folding board 21 faces a long side of the second longitudinal folding board 23 and a short side of the third longitudinal folding board 25, and a short side of the fourth longitudinal folding board 27 faces a short side of the second longitudinal folding board 23 and a long side of the third longitudinal folding board 25. The first bevel edge 211 of the first longitudinal folding board 21 is approximately parallel to the third bevel edge 251 of the third longitudinal folding board 25, and the second bevel edge 231 of the second longitudinal folding board 23 is approximately parallel to the fourth bevel edge 271 of the fourth longitudinal folding board 27. A part of the fourth bevel edge 271 of the fourth longitudinal folding board 27 is disposed below a part of the second bevel edge 231 of the second longitudinal folding board 23 and also overlaps the part of the second bevel edge 231.

Figure 5A:
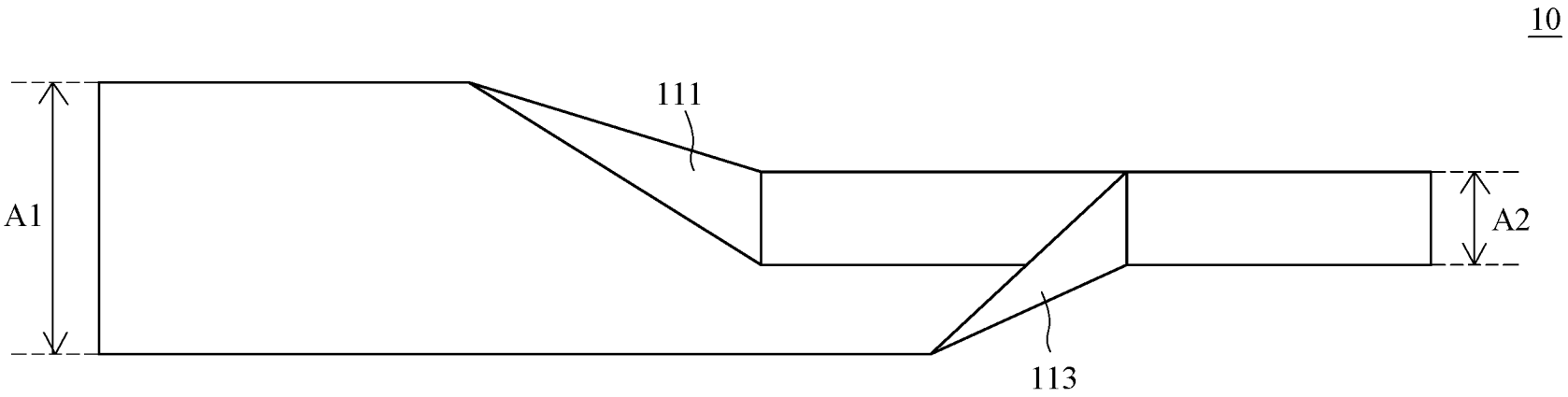
FIG. 5A is a schematic diagram of a paper web after being longitudinally folded according to an embodiment of the invention.
Figure 5B:
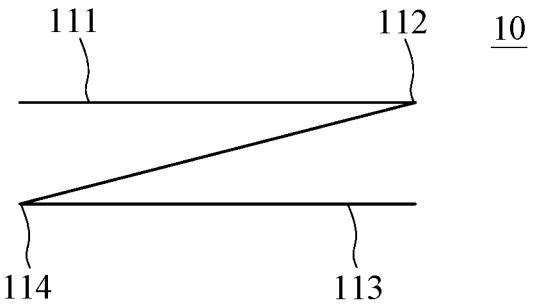
FIG. 5B is a cross sectional view of a paper web after being longitudinally folded according to the schematic diagram in FIG. 5A.

The longitudinal folding procedure executed by the longitudinal folding unit 20 to the paper web 10 is hereafter explained with additional reference to FIGS. 5A and 5B. First, the paper web 10 is delivered to the longitudinal folding unit 20 via a traction wheel 65 and enters the longitudinal folding unit 20 from under a long side of the first longitudinal folding board 21, wherein a first side 111 of the paper web 10 folds inwardly in a longitudinal direction along the first bevel edge 211 of the first longitudinal folding board 21. Next, the longitudinally-folded first side 111 of the paper web 10 enters and passes through a gap between the second longitudinal folding board 23 and the third longitudinal folding board 25 from the third bevel edge 251, thereby generating a first folding line 112 on the first side 111, and meanwhile, a second side 113 of the paper web 10 concurrently folds inwardly in the longitudinal direction along the second bevel edge 231 of the second longitudinal folding board 23. Subsequently, the longitudinally-folded second side 113 of the paper web 10 enters and passes through a gap between the second longitudinal folding board 23 and the fourth longitudinal folding board 27 from the fourth bevel edge 271, thereby generating a second folding line 114 on the second side 113. The paper web 10 has a Z-fold thereon after the longitudinally folding procedure is executed by the longitudinal folding unit 20; the z-fold divides the paper web 10 into three folding surfaces, for example, originally the paper web 10 had a total width (A1) of 186 mm, and after longitudinal folding, the width of the paper web 10 became 60.5 mm±2.0 mm.

According to an embodiment of the invention, the folding machine 100 further includes a first adjustment hand wheel 22, a second adjustment hand wheel 24, and a third adjustment hand wheel 26. The first adjustment hand wheel 22 is connected to the first longitudinal folding board 21, and used for adjusting the position of the first longitudinal folding board 21. The second adjustment hand wheel 24 is connected to the second longitudinal folding board 23, and used for adjusting the positions of the second longitudinal folding board 23 and the third longitudinal folding board 25. The third adjustment hand wheel 26 is connected to the fourth longitudinal folding board 27, and used for adjusting the positions of the fourth longitudinal folding board 27. Therefore, through the first adjustment hand wheel 22, the second adjustment hand wheel 24, and the third adjustment hand wheel 26, an operator of the folding apparatus 100 can adjust the positions of the first longitudinal folding board 21, the second longitudinal folding board 23, the third longitudinal folding board 25, and the fourth longitudinal folding board 27 to ensure the width of the longitudinally-folded paper web 10 meets the requirement and to increase the quality and quantity of paper handkerchief production without halting the operation of the folding machine 100.

Moreover, the folding machine 100 of the invention further includes an embossing assembly 50 disposed beside the longitudinal folding unit 20. The embossing assembly 50 includes an embossing wheel 51 and an embossing adjustment device 53, wherein the paper web 10 can be delivered on the embossing adjustment device 53 and the embossing adjustment device 53 is used to adjust where on the paper web 10 the embossing wheel 51 would emboss. The longitudinal folding unit 20 of the invention executes the longitudinal folding procedure to the embossed paper web 10.

Furthermore, the folding machine 100 of the invention also includes a paper web tension adjustment device 60 disposed between the embossing assembly 50 and the longitudinal folding unit 20. The paper web tension adjustment device 60 includes two delivery wheels 63 having rough surfaces and a servomotor 61. The servomotor 61 is electrically connected to the delivery wheels 63. The paper web 10 can be delivered on the delivery wheels 63. The servomotor 61 controls the rotation speed of the two delivery wheels 63 in a way of acceleration and deceleration to adjust the tension of the paper web 10, thereby maintaining a stable tension in the paper web 10 entering the longitudinal folding unit 20, and consequently reduces the probability of permanent pleats or resilient pleats from happening.

Subsequently, the longitudinally-folded paper web 10 is delivered to the transverse folding unit 30 via a traction bar 28. The transverse folding unit 30 includes a cutter wheel 31, a bed knife wheel 33, a first folding wheel 35, a second folding wheel 37, and a main folding wheel 39. The bed knife wheel 33 is disposed between the cutter wheel 31 and the main folding wheel 39, and the first folding wheel 35 and the second folding wheel 37 are respectively disposed next to the main folding wheel 39. In an embodiment of the invention, the cutter wheel 31 and the main folding wheel 39 rotate in a clockwise direction, and the bed knife wheel 33, the first folding wheel 35, and the second folding wheel 37 rotate in a counterclockwise direction. The cutter wheel 31 includes at least three cutters 311 disposed on the wheel surface of the cutter wheel 31 at equal distances. The bed knife wheel 33 includes at least three bed knives 331 disposed on the wheel surface of the bed knife wheel 33 at equal distances. The first folding wheel 35 includes a first folding knife 351 and a first air hole 353, and the second folding wheel 37 includes a second folding knife 371 and a second air hole 373.

The transverse folding unit 30 executes the transverse folding procedure to the paper web 10 of for paper handkerchiefs. First, the longitudinally-folded paper web 10 is delivered between the cutter wheel 31 and the bed knife wheel 33 via the traction bar 28 and is cut sequentially by the cutters 311 of the cutter wheel 31 and the bed knifes 331 of the bed knife wheel 331 into a paper handkerchief 11 with a predetermined length, like 186 mm. In the present invention, since the cutter wheel 31 and the bed knife wheel 33 have at least three cutters 311 and at least three bed knives 331, respectively, the probability of wear and tear on the blades of the cutter wheel 31 and the bed knife wheel 33 is reduced, which prevents the incomplete cutting of the paper web 10.

After the cutting process, each of the paper handkerchiefs 11 is adhered to the main folding wheel 39 and rotates with the main folding wheel 39 in clockwise. When the paper handkerchief 11 is delivered to the first folding wheel 35 by the main folding wheel 39 and a front end of the paper handkerchief 11 comes in contact with the first air hole 353 of the first folding wheel 35, the paper piece 11 is adhered to the first folding wheel 35 by suction and rotates with the first folding wheel 35 in counterclockwise. When a length of the paper handkerchief 11 being adhered to the first folding wheel 35 equals one half of a total length of the paper handkerchief 11, the first air hole 353 releases air to relieve the suction, and thus the paper handkerchief 11 does not continue to rotate with the first folding wheel 35 and does a first transverse fold under the influence of the first cutting knife 351. A length of the folded paper handkerchief 11 is approximately one half of the original total length of the paper handkerchief 11. For instance, the length of the folded paper handkerchief 11 is 93 mm±1.0 mm. The folded paper handkerchief 11 then rotates with the main folding wheel 39 in clockwise. In an embodiment of the present invention, an arc length between the first air hole 353 and the first cutter 351 is equal to one half of the total length of the paper handkerchief 11.

The paper handkerchief 11 folded in half-length rotates with the main folding wheel 39 and is delivered to the second folding wheel 37. When a front end of the folded paper handkerchief 11 comes in contact with the second air hole 373 of the second folding wheel 37, the folded paper handkerchief 11 is adhered to the second folding wheel 37 by suction and rotates with the second folding wheel 37 in counterclockwise. When a length of the folded paper handkerchief 11 being adhered to the second folding wheel 37 equals to one fourth of the total length of the folded paper handkerchief 11, the second air hole 373 releases air to relief the suction, and thus the folded paper handkerchief 11 stops to rotate with the second folding wheel 37 and folds transversely for a second time under the influence of the second cutting knife 371. The now twice-folded paper handkerchief 11 has a length that is approximately one fourth of the original total length of the paper handkerchief 11, for example, the length of the twice-folded paper handkerchief 11 is 47 mm+1.0 mm. In an embodiment of the present invention, an arc length between the second air hole 373 and the second cutter 371 is equal to one fourth of the total length of the paper handkerchief 11.

In addition, the folding machine 100 of the invention includes a divert wheel 40. The divert wheel 40 disposed beside the main folding wheel 39 includes at least three air hole portions 41 and rotates in counterclockwise. When the twice-folded paper handkerchief 11 is delivered to the divert wheel 40 due to the rotation of the main folding wheel 39, the divert wheel 40 adheres the twice-transversely-folded paper handkerchief 11 via the air hole portions 41. The paper handkerchief 11 with two transverse folds is delivered to a collecting mechanism through the rotation of the divert wheel 40, and the collecting mechanism stacks and packages a plurality of the twice-folded paper handkerchief 11 so as to make a product of paper handkerchief.

Furthermore, the transverse folding unit 30 includes a first platen wheel 36 and a second platen wheel 38, both of which are disposed next to the main folding wheel 39. After the first transverse folding by the first folding wheel 35, the paper handkerchief 11 is led by the main folding wheel 39 to the first platen wheel 36 and is pressed between the main folding wheel 39 and the first platen wheel 36. As well, after the second transverse folding by the second folding wheel 37, the paper handkerchief 11 is led to the second platen wheel 38 by the main folding wheel 39 and is pressed between the main folding wheel 39 and the second platen wheel 38. Therefore, through the implementation of the first platen wheel 36 and the second platen wheel 38, the folding lines on the paper piece 11 formed from the longitudinal and transverse folding procedures are more distinctively clear for achieving a better folding effect.

Figure 6:
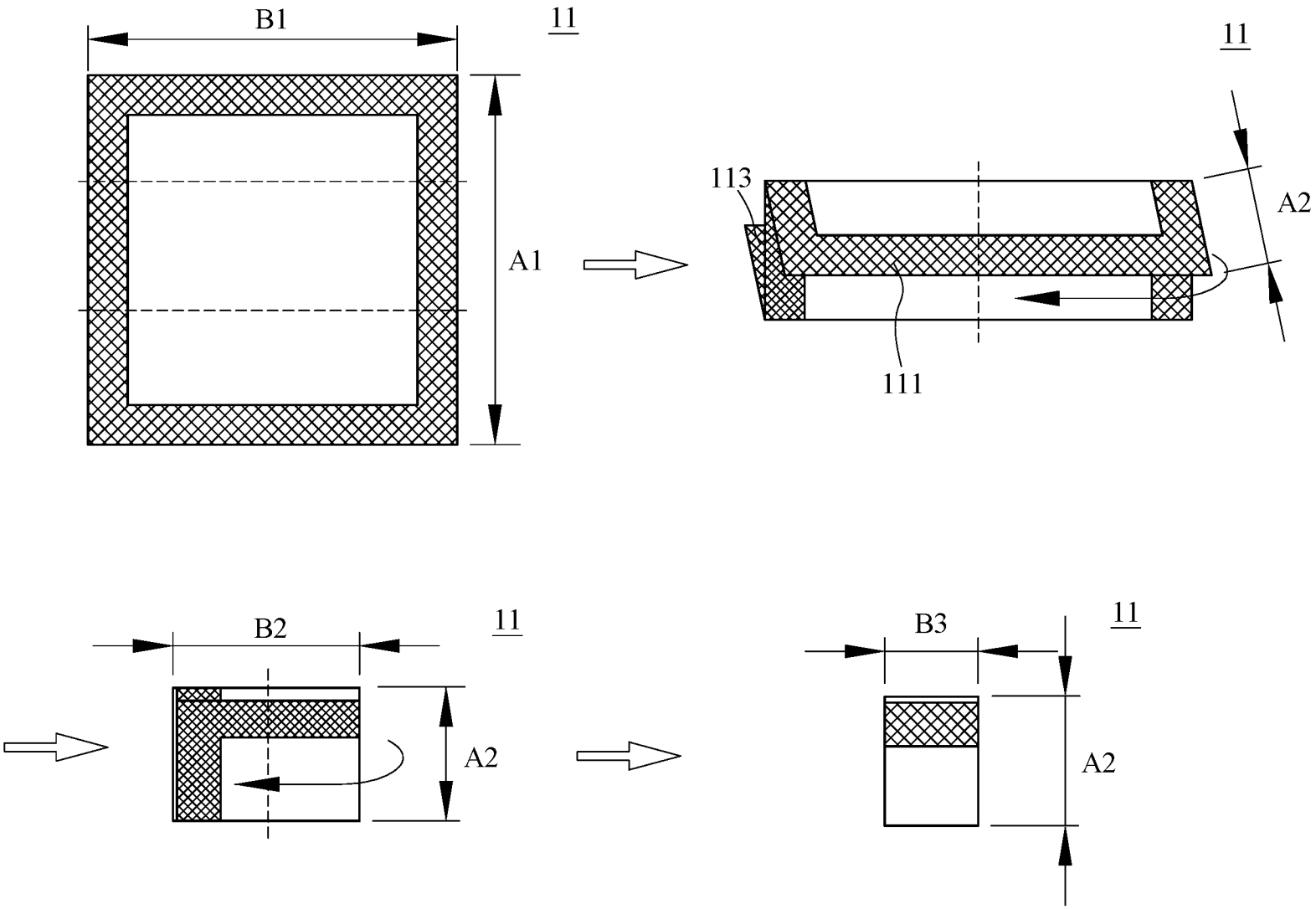
FIG. 6 illustrates a paper handkerchief folding process according to an embodiment of the invention.

Referring to FIG. 6, the folding process of the invention is illustrated. The paper handkerchief 11 is cut from the paper web 10 and has a size of B1×A1, such as 186 mm×186 mm. After longitudinal folding, the width size of the paper handkerchief 11 is A2, like 60.5 mm±2.0 mm. Next, the length of the longitudinally-folded paper handkerchief 11 after one transverse folding is reduced from B1 to B2, like from 186 mm to 93 mm±1.0 mm. Further, the length of the paper handkerchief 11 after another transverse folding is reduced from B2 to B3, like from 93 mm±1.0 mm to 47 mm±1.0 mm.

Concluding from above, the paper handkerchief of the invention can be folded by the longitudinal folding unit 20 and the transverse folding unit 30 to form a paper handkerchief 11 that meets the width and length requirements and with clear and distinct folding lines, thus the packaged paper handkerchief product can have higher quality.

The above disclosure is only the preferred embodiment of the present invention, and not used for limiting the scope of the present invention. All equivalent variations and modifications on the basis of shapes, structures, features and spirits described in claims of the present invention should be included in the claims of the present invention.

What is claimed is:

1. A folding machine for forming paper handkerchiefs folded in a longitudinal direction and a transverse direction, the folding machine comprising:

a longitudinal folding unit comprising:

a first longitudinal folding board comprising a first bevel edge;

a second longitudinal folding board comprising a second bevel edge;

a third longitudinal folding board mounted above the second longitudinal folding board and comprising a third bevel edge parallel to the first bevel edge; and a fourth longitudinal folding board comprising a fourth bevel edge parallel to the second bevel edge, wherein the second longitudinal folding board and the third longitudinal folding board are configured between the first longitudinal folding board and the fourth longitudinal folding board, and a part of the fourth bevel edge of the fourth longitudinal folding board and a part of the second bevel edge of the second longitudinal folding board are overlapped;

wherein a paper web is fed into the longitudinal folding unit, one side of the paper web is folded inwardly in the longitudinal direction along the first bevel edge of the first longitudinal folding board, the longitudinally folded side of the paper web passes through a gap between the second longitudinal folding board and the third longitudinal folding board while another side of the paper web is being folded inwardly in the longitudinal direction along the second bevel edge of the second longitudinal folding board, and the another longitudinally folded side of the paper web passes through a gap between the second longitudinal folding board and the fourth longitudinal folding board; and a transverse folding unit disposed beside the longitudinal folding unit for receiving the longitudinally folded paper web, comprising:

a cutter wheel comprising at least three cutters;

a bed knife wheel disposed next to the cutter wheel and comprising at least three bed knives, wherein the paper web is fed between the cutters of the cutter wheel and the bed knives of the bed knife wheel and is sequentially cut into a paper handkerchief;

a first folding wheel;

a second folding wheel; and a main folding wheel, wherein the bed knife wheel, the first folding wheel, and the second folding wheel are respectively disposed next to the main folding wheel, each of the paper handkerchiefs is adhered to the main folding wheel and is delivered thereby to the first folding wheel and the second folding wheel sequentially, the first folding wheel is for folding the paper handkerchief in the transverse direction for a first time and the second folding wheel is for folding the paper handkerchief in the transverse direction for a second time.

2. The folding machine according to claim 1, further comprising:

a first adjustment hand wheel connected to the first longitudinal folding board for adjusting a position of the first longitudinal folding board;

a second adjustment hand wheel connected to the second longitudinal folding board for adjusting a position of the second longitudinal folding board and a position of the third longitudinal folding board; and a third adjustment hand wheel connected to the fourth longitudinal folding board for adjusting a position of the fourth longitudinal folding board.

3. The folding machine according to claim 1, further comprising an embossing wheel and an embossing adjustment device disposed next to the embossing wheel, the paper web being delivered on the embossing adjustment device, wherein the embossing adjustment device is used to adjust where on the paper web the embossing wheel embosses, and the longitudinal folding unit folds the embossed paper web longitudinally.

4. The folding machine according to claim 1, further comprising a paper web tension adjustment device, the paper web tension adjustment device comprising a servomotor and two delivery wheels with rough surface, wherein the servomotor is electrically connected to the two delivery wheels and controls a rotation speed of the two delivery wheels in a way of acceleration and deceleration, and the paper web is delivered to the longitudinal folding unit via the paper web tension adjustment device.

5. The folding machine according to claim 1, wherein the transverse folding unit further comprises a first platen wheel and a second platen wheel, both of which are disposed next to the main folding wheel, the paper handkerchief folded transversely for the first time is delivered by the main folding wheel to the first platen wheel and is pressed by the first platen wheel, and the paper handkerchief folded transversely for the second time is delivered to the second platen wheel by the main folding wheel and is pressed by the second platen wheel.

6. The folding machine according to claim 1, wherein the first folding wheel comprises a first folding knife and a first air hole, the first folding wheel adheres the paper handkerchief from the main folding wheel via the first air hole for folding the paper handkerchief transversely for the first time.

7. The folding machine according to claim 6, wherein an arc length between the first folding knife and the first air hole is one half of a total length of the paper handkerchief, and when a length of the paper handkerchief being adhered to the first folding wheel is equal to one half of the total length of the paper handkerchief, the first air hole releases air and the paper handkerchief is folded transversely for the first time under the influence of the first folding knife.

8. The folding machine according to claim 7, wherein the second folding wheel comprises a second folding knife and a second air hole, the second folding wheel adheres the paper handkerchief from the main folding wheel via the second air hole so as to fold the paper handkerchief transversely for the second time.

9. The folding machine according to claim 8, wherein an arc length between the second folding knife and the second air hole is one fourth of the total length of the paper handkerchief, and when a length of the paper handkerchief being adhered to the second folding wheel is equal to one fourth of the total length of the paper handkerchief, the second air hole releases air and the paper handkerchief folds transversally for the second time under the influence of the second folding knife.

10. The folding machine according to claim 1, further comprising a divert wheel disposed next to the main folding wheel and having a plurality of air holes, wherein the divert wheel adheres the paper handkerchief, which has folded transversely for the second time, from the main folding wheel via the air holes, and with a rotation of the divert wheel, dispenses the paper handkerchief from the folding machine.

* * * * *